US005460207A

United States Patent [19]

Meshberg

[11] Patent Number: 5,460,207

[45] Date of Patent: Oct. 24, 1995

[54] APPARATUS AND METHOD FOR FILLING AND DISPENSING A HIGHLY VISCOUS PRODUCT FROM A CONTAINER

[76] Inventor: Philip Meshberg, 2770 S. Ocean Blvd. Apt. 602, Palm Beach, Fla. 33480

[21] Appl. No.: 222,975

[22] Filed: Apr. 5, 1994

Related U.S. Application Data

[62] Division of Ser. No. 887,032, May 22, 1992, Pat. No. 5,305,810.

[51] Int. Cl.[6] ..... B65B 1/04; B65D 37/00

[52] U.S. Cl. ..... 141/1; 141/7; 141/18; 141/113; 141/374; 222/211

[58] Field of Search ..... 141/59, 60, 1, 141/2, 3, 7, 5, 18, 20, 113, 374, 86, 14; 220/705–710, 366, 86.2; 215/1 A; 222/209–215, 464, 493, 477, 572, 567, 569, 481, 481.5; 137/588, 592

[56] References Cited

U.S. PATENT DOCUMENTS

| | | | |
|---|---|---|---|
| 2,671,590 | 3/1954 | McBean et al. | 141/3 |
| 3,255,786 | 6/1966 | Kaiser, Jr. | 141/7 |
| 3,283,727 | 11/1966 | Rodrigues | 103/203 |
| 3,361,303 | 1/1968 | Jacuzzi et al. | 222/183 |
| 3,550,649 | 12/1970 | Meshberg | 141/3 |
| 3,648,907 | 3/1972 | Marchant | 222/212 |
| 3,672,543 | 6/1972 | Roper et al. | 222/183 |
| 3,877,271 | 4/1975 | Maddock | 72/23 |
| 3,908,718 | 9/1975 | Bower | 141/59 |
| 4,069,950 | 1/1978 | Archer | 222/210 |
| 4,327,782 | 5/1982 | McKibben et al. | 141/26 |
| 4,501,374 | 2/1985 | Robertson | 220/86.2 |
| 4,545,510 | 10/1985 | Mettenbrink | 222/209 |
| 4,625,897 | 12/1986 | Wortley | 222/205 |
| 4,634,028 | 1/1987 | de Larosiere | 222/464 |
| 4,750,647 | 6/1988 | Cohen | 141/24 |
| 4,781,313 | 1/1988 | Verheyen | 222/464 |
| 4,865,224 | 9/1989 | Streck | 222/95 |
| 4,869,283 | 9/1989 | Oeffling et al. | 141/59 |
| 4,981,238 | 1/1991 | Wennmekers | 222/103 |

FOREIGN PATENT DOCUMENTS

| | | |
|---|---|---|
| 0193054 | 9/1986 | European Pat. Off. . |
| 0473994 | 3/1992 | European Pat. Off. . |
| 0499538 | 8/1992 | European Pat. Off. . |
| 2655315 | 6/1991 | France . |
| 2710984 | 9/1978 | Germany . |
| 82 02034 | 6/1982 | WIPO . |

*Primary Examiner*—Henry J. Recla
*Assistant Examiner*—Steven O. Douglas
*Attorney, Agent, or Firm*—Kenyon & Kenyon

[57] ABSTRACT

A method and apparatus for filling of a dispensing container with a product to be dispensed, particularly useful for highly viscous products, in which the container has a vented dip tube structure which is inserted into the container before it is filled. Filling is accomplished by inserting a filling nozzle into the container so that it cooperates with the top of the dip tube. Filling of the container therefore occurs through the dip tube. The vent in the dip tube structure allows the air in the container to be vented as the container is filled. Because the container is filled through the dip tube, the product completely fills the dip tube at the time when the pump structure is inserted into the container. The vent structure can be used as a vent for the container during a dispensing operation as well.

9 Claims, 6 Drawing Sheets

APPARATUS AND METHOD FOR FILLING AND DISPENSING A HIGHLY VISCOUS PRODUCT FROM A CONTAINER

This is a division of application Ser. No. 07/887,032, now U.S. Pat. No. 5,305,810 filed May 22, 1992.

BACKGROUND OF THE INVENTION

The present invention relates to the dispensing of products from a container using an attached pump, and more particularly to an apparatus and method for allowing a dispensing device to be advantageously used for highly viscous products.

Container-mounted pumps are often used for the dispensing of liquid home-care or personal products from a container or bottle. Generally, the pump is supplied with a syphon or "dip" tube which has been attached to the pump during assembly of the pump, and which is of a relatively narrow diameter. In this arrangement, the container or bottle is first filled with the product to be dispensed, and then the pump/dip tube combination is inserted into the filled container and attached to the bottleneck. This filling and assembly procedure leaves a column of air within the dip tube and in the pump. The column of air occurs because the dip tube is inserted into the liquid from above, and the air has no means for escaping from the dip tube during insertion, the pump inlet and/or outlet valves being normally sealed.

The column of air in the dip tube must be removed from the dip tube and pump before the product can be dispensed. The pump therefore must be "primed" by a user before any product will come out of the pump nozzle. Priming is the procedure whereby the actuator is pushed in one or more times to clear trapped air from the pump and dip tube and to draw product up the dip tube, into the pump, and out the nozzle.

The process of priming is relatively simple when the product to be dispensed is of low viscosity, as with most personal and home-care products. However, certain cosmetic products, such as makeup, are highly viscous. The high viscosity of these products makes the priming of a pump filled in the above-described conventional manner extremely difficult and time-consuming. This is because of the high viscosity of the product makes it necessary for a substantial force to pull the product up the entire length of the dip tube. Even when a dip tube of relatively large diameter is used, it may take more than 35 actuations of the actuator to prime the pump. For a consumer, this result is very undesirable. To prevent this result additional steps can be taken during the packaging operation. One method for preventing additional priming is to place a vacuum onto the pump after it has been attached to the container, thereby drawing the product up the dip tube. This procedure requires the additional assembly and disassembly steps of removing and replacing the actuator, as well as the need for opening the normally closed inlet and/or outlet valves. These additional steps can be expensive and time consuming, and can add to the cost of packaging the product.

The present invention is directed to a method and apparatus for solving the above problems. The present method and apparatus are particularly useful in that they do not require disassembly and reassembly of the pump structure during the filling process, unlike the procedure mentioned above using vacuum priming. The present invention therefore is much more economical and efficient than this method, and still provides the same advantages in terms of priming.

DETAILED DESCRIPTION

Figure 1:
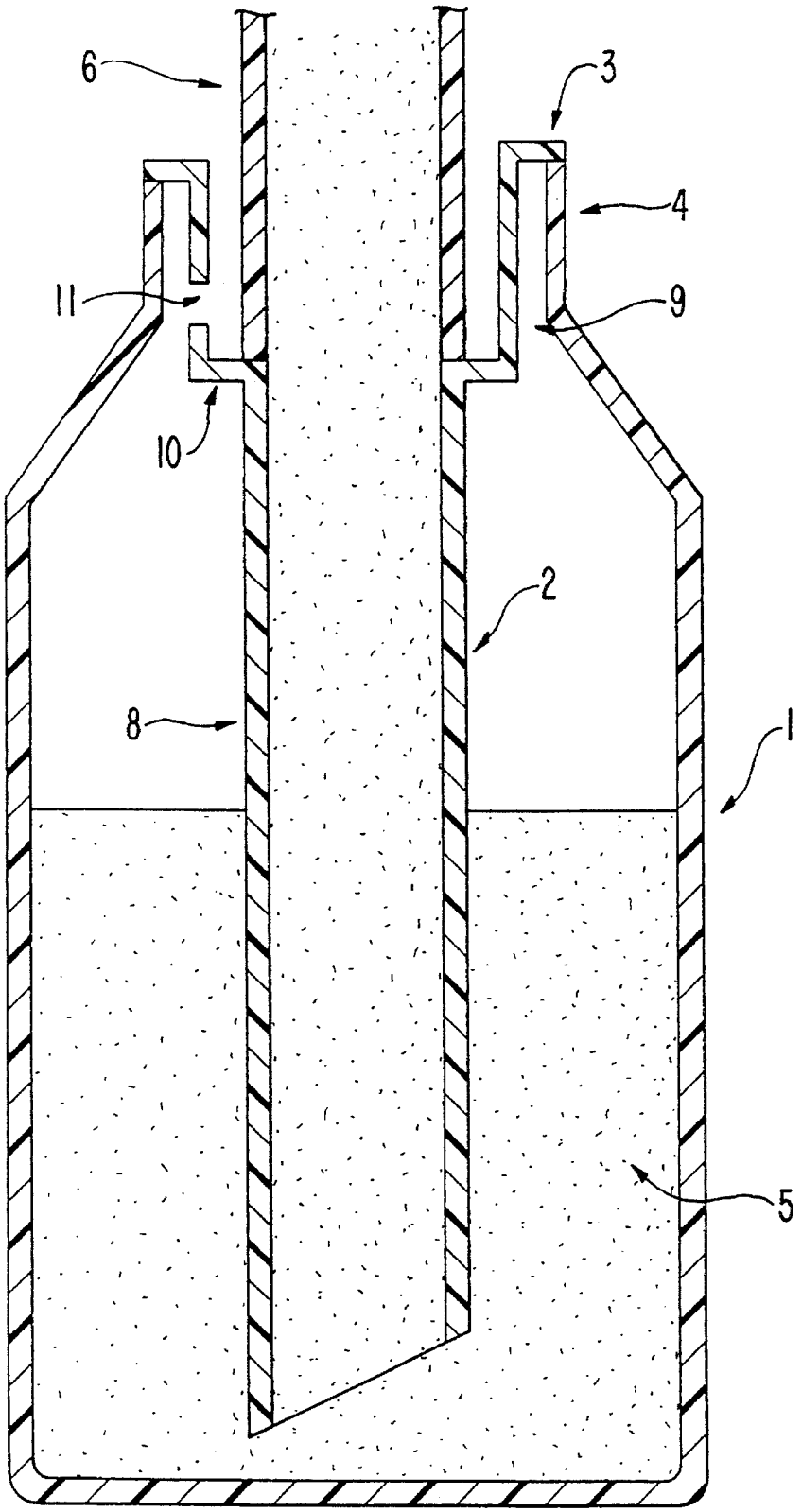
FIG. 1 shows a first embodiment of the present invention during a filling operation.

FIG. 1 represents the present invention during a filling operation. A container or bottle 1 of any conventional type used for holding a product to be dispensed has inserted therein a syphon or dip tube structure 2. The dip tube structure 2 can be a separately formed, as shown in FIG. 1, or could be integrally molded with container 1. Dip tube structure 2 has a radially-extending flange 3 which cooperates with the neck 4 of container 1 to seat dip tube structure 2 in container 1. Dip tube structure 2 also has a dip tube 8 and an upper portion 9. Dip tube structure 2 is inserted into container 1 before container 1 is filled with product 5.

After insertion of dip tube structure 2 into container 1, container 1 is filled with a product 5 to be dispensed from container 1. Filling is accomplished by inserting a filling nozzle 6 into the upper portion 9 of dip tube structure 2. The bottom of filling nozzle 6 cooperates with a flange 10 on upper portion 9. Product 5 is then pumped or forced out filling nozzle 6, down dip tube 8, and into container 1. Upper portion 9 has a vent path 11. As product 5 flows into container 1, the air in the container which it displaces is pushed up to the top of the container 1 and out vent path 11. Filling of product 5 into container 1 is continued until the quantity of product 5 in container 1 reaches a desirable level, generally when product 5 reaches the level of the flange 10.

Figure 2:
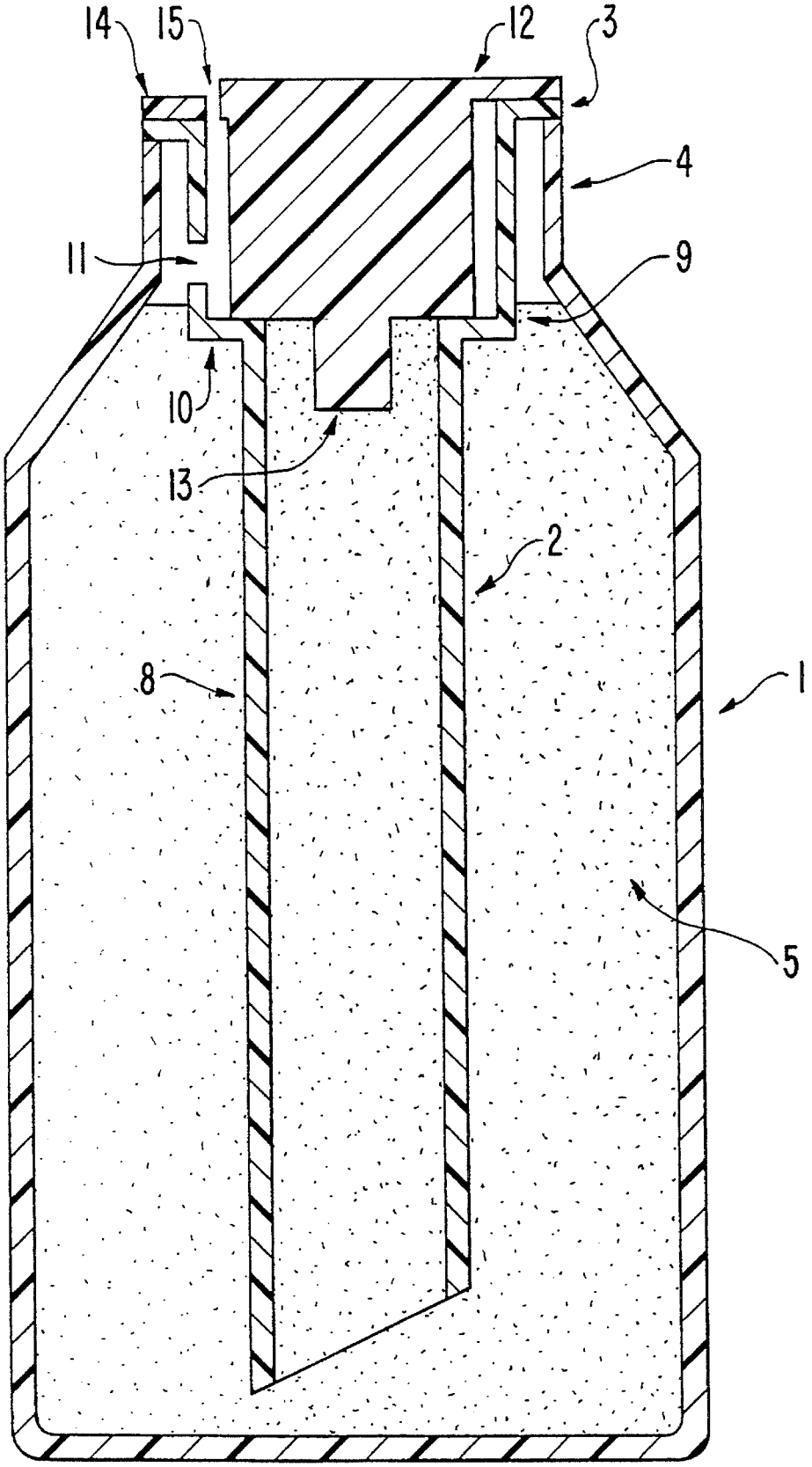
FIG. 2 shows the first embodiment of the present invention after a filling operation, with the pump mounted to the container.

FIG. 2 represents the apparatus of the present invention after filling has been completed, and immediately after insertion of a pump 12 (shown schematically in FIG. 2). The internal structure of pump 12 can be of any type known to those skilled in the art for dispensing product from a container. As can be seen in FIG. 2, because of the manner in which container 1 was filled according to the description above, the product has filled the interior of the dip tube 8 all the way up to the flange 10. Therefore, when pump 121 is inserted into upper portion 9, as shown in FIG. 2, there is no air in dip tube 8. The lower inlet 13 of pump 12 is inserted directly into product 5. Priming the pump requires only drawing the product 5 through lower inlet 13 and into pump 12. This arrangement makes priming of pump 12 much easier, since only the air in pump 12 must be evacuated, and there is no air in dip tube 8 which must be drawn up and out of the nozzle. To aid in the filling and priming of the pump-container combination when highly viscous products are used, it is advantageous to make the dip tube 8 of a relatively large diameter.

As shown in FIG. 2, pump 12 has an upper flange 14 which may cooperate with the flange 3 and neck 4 to secure the pump 12 to the container 1. Flange 14 can have a vent path 15. Vent paths 11 and 15 cooperate to allow venting of the container during dispensing operations, i.e., during operation of pump 12. Thus, as product 5 is drawn out of container 1 by the action of pump 12, air will travel through vent paths 11 and 15 to fill the resulting space in container 1.

Figure 3:
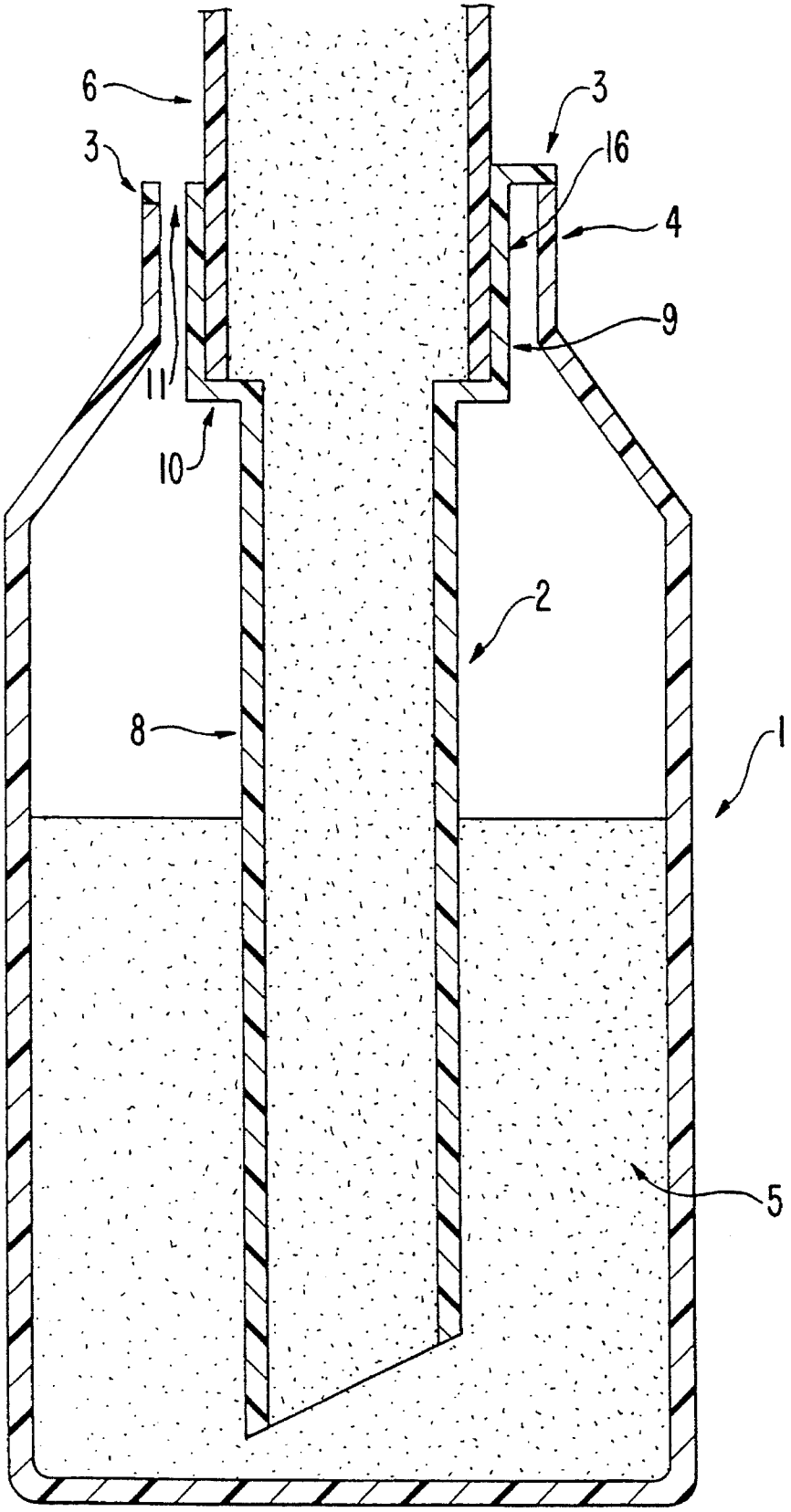
FIG. 3 shows a second embodiment of the present invention during a filling operation.
Figure 4:
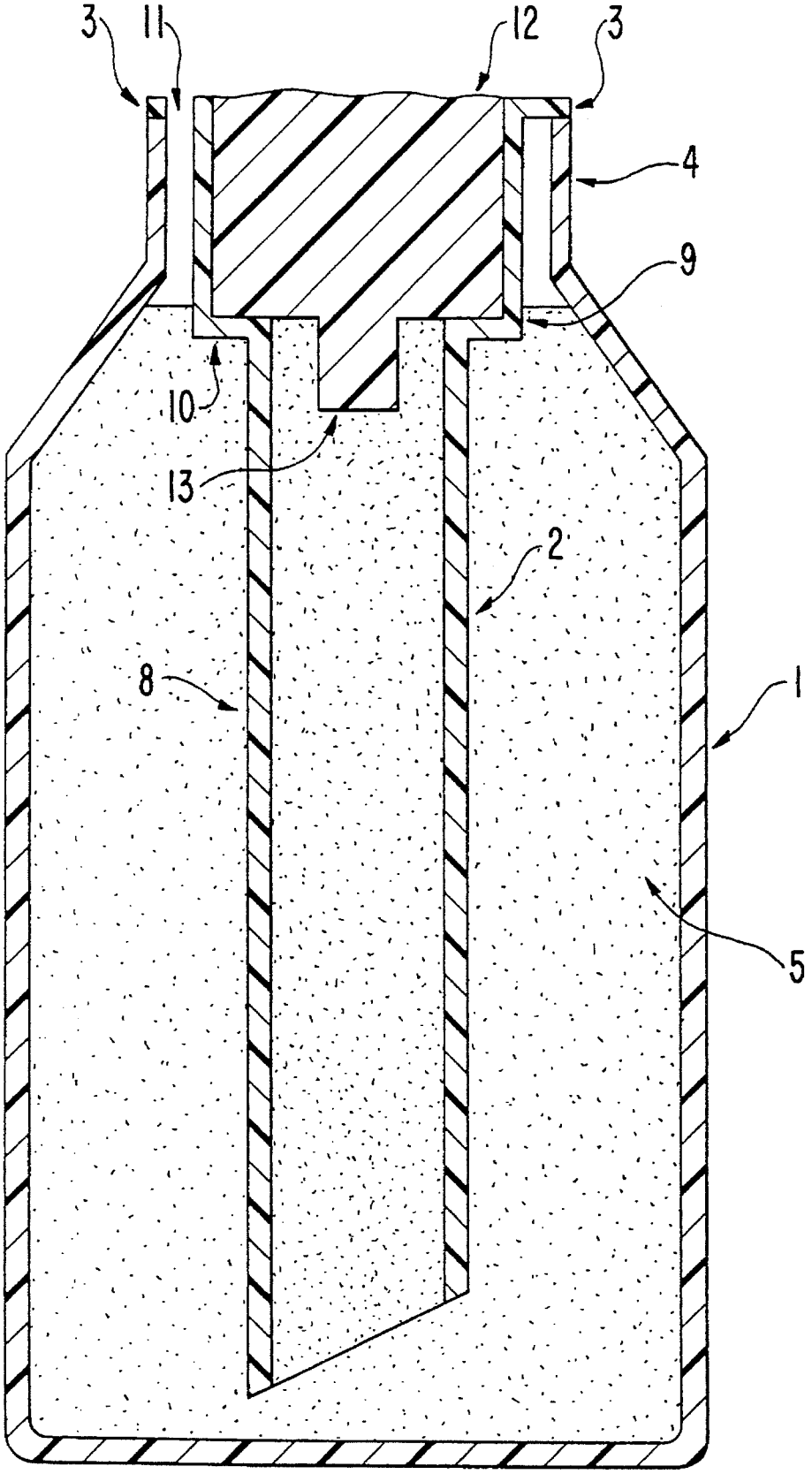
FIG. 4 shows the second embodiment of the present invention after a filling operation, with the pump mounted to the container.

FIG. 3 shows an alternative embodiment where the vent path 11 is located on flange 3. This embodiment allows the filling nozzle to cooperate with both the flange 10 and sidewalls 16 of upper portion 9. FIG. 4 shows this embodiment with the pump 12 inserted. As can be seen in FIG. 4, this embodiment allows the pump 12 body to cooperate with the flange 10 as well as sidewalls 16. There is therefore no need for an engaging flange on pump 12. Venting of the container during a dispensing operation can occur directly through vent path 11.

Figure 5:
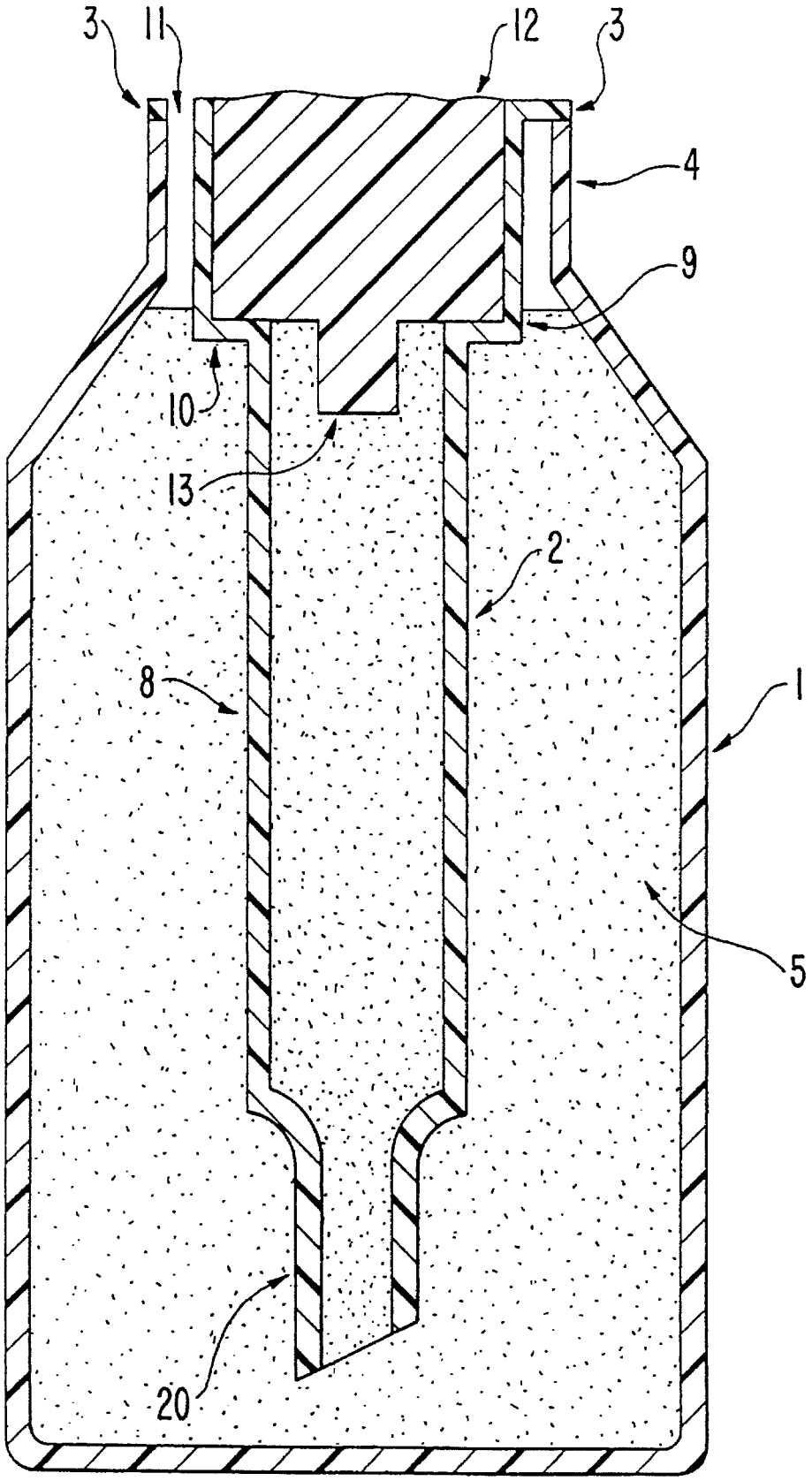
FIG. 5 shows a first alternative configuration of the dip tube in the present invention.

FIG. 5 demonstrates that the dip tube 8 of the present invention need not be straight-sided as shown in FIGS. 1–4. Dip tube 8 may have a narrowed portion 20, or alternatively a series of stepped portions gradually increasing in diameter. The size and shape of dip tube can be designed to be particularly effective for the degree of viscosity of the product to be dispensed. Stepping of the dip tube 8 allows the portion of product left in the dip tube after the container is empty to be reduced.

Figure 6:
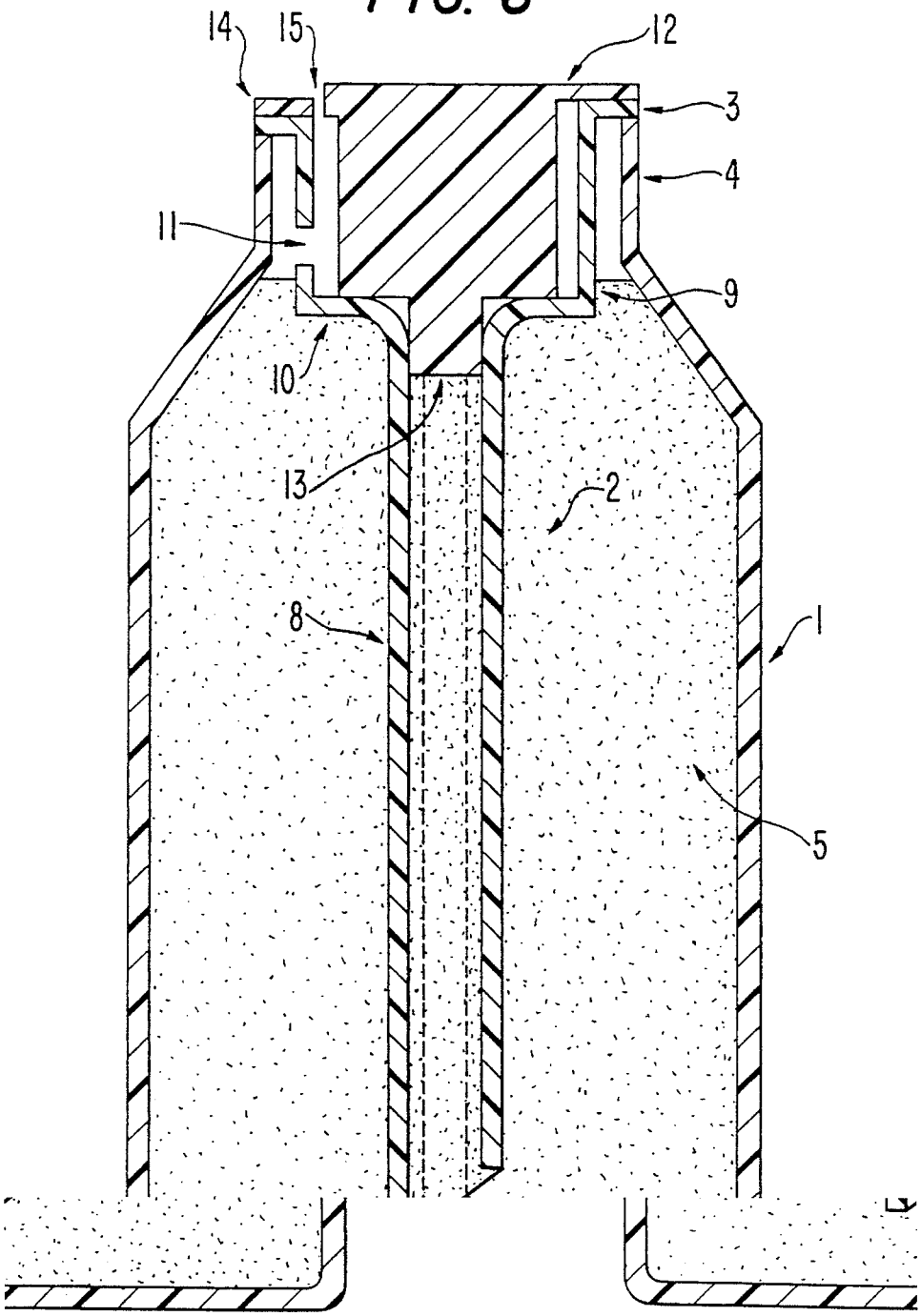
FIG. 6 shows a second alternative configuration of the dip tube in the present invention.
Figure 7:
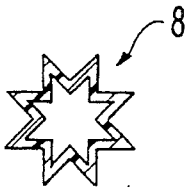
FIG. 7 shows a cross-sectional view of the dip tube of the second alternative configuration, after the pump is mounted to the container.
Figure 8:
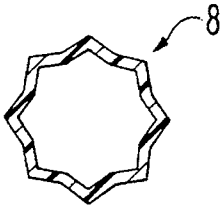
FIG. 8 shows a cross-sectional view of the dip tube of the second alternative configuration, during the filling process.

FIGS. 6–7 show an alternative design of the dip tube in the present invention. FIGS. 7 and 8 are cross-sectional views of the dip tube in this alternative design. As can he seen from these figures, the dip tube is corrugated along its length. The dip tube is constructed of a resilient material so that it is normally in the configuration shown in FIG. 7. FIG. 8 represents the dip tube configuration during a filling process. Thus, when filling nozzle 6 is inserted into upper portion 9 and product is pumped or forced out of filling nozzle 6, the pressure of the product pushes the walls of dip tube 8 outwardly so That the dip tube assumes the configuration shown in FIG. 8. The increase in size of the diameter of the dip tube 8 allows filling of the container 1 to proceed rapidly. After filling is completed, the resiliency of the dip tube 8 causes the corrugations to collapse to the configuration of FIG. 7. This configuration allows the volume of the dip tube 8 to be reduced. Reducing the volume of the dip tube 8 ensures That there is a relatively small volume of product left over in the dip tube after all of the product 5 has been evacuated from the container 1 during a dispensing operation. Although FIG. 6 shows the corrugated dip tube structure used with the upper portion structure of FIGS. 1–2, this dip tube structure could be used equally well with the upper portion structure of FIGS. 3–4.

One technique which can be used to assist in the filling of the apparatus of the present invention is to apply a vacuum to vent 11, thereby drawing out excess air in container 1 and assisting in drawing product 5 from filling nozzle 6 into container 1. This use of a vacuum is easily accomplished during a filling operation, and does not require dissasembly of any of the parts of the apparatus, unlike the circumstance where the product must be drawn up a dip tube by the application of a vacuum to the pump.

What is claimed is:

1. A method for filling a container with a product to be dispensed comprising the steps of:

providing a container;

disposing a dip tube structure at least partially within the container, said dip tube structure comprising a dip tube and a vent path, such that said dip tube extends substantially axially inwardly into the container;

engaging a filling nozzle with the dip tube structure near an axially outward end of said dip tube;

dispensing a product through said filling nozzle so that it flows through said dip tube and into said container while applying a vacuum to said vent path, whereby said product completely fills said dip tube, air is drawn from said container, and product is drawn into said container;

disengaging said filling nozzle from said dip tube structure; and attaching a pump to said dip tube structure after said step of disengaging said filling nozzle from said dip tube structure.

2. The method of claim 1, further comprising the step of:

providing a flange on said dip tube structure which engages said container, and providing said vent path through said flange.

3. The method of claim 1, further comprising the step of:

providing an axially-inwardly projecting sidewall on said dip tube structure, and providing said vent path through said sidewall.

4. The method of claim 1, further comprising the step of:

providing a circumferential flange connected to said dip tube structure, said filling nozzle engaging said circumferential flange during said steps of engaging a filling nozzle with the dip tube structure and dispensing a product through said filling nozzle.

5. The method of claim 1, further comprising the step of: varying the diameter of said dip tube along said dip tube's axial length.

6. A method for filling a container with a product to be dispensed comprising the steps of:

providing a container;

disposing a dip tube structure at least partially within the container, said dip tube structure comprising a dip tube, such that said dip tube extends substantially axially inwardly into the container;

engaging a filling nozzle with the dip tube structure near an axially outward end of said dip tube;

dispensing a product through said filling nozzle so that it flows through said dip tube and into said container, whereby said product completely fills said dip tube;

disengaging said filling nozzle from said dip tube structure; and attaching a pump to said dip tube structure after said step of disengaging said filling nozzle from said dip tube structure.

7. The method of claim 6, further comprising the step of:

providing a circumferential flange connected to said dip tube, and engaging said pump with said circumferential flange.

8. The method of claim 6, further comprising the step of:

providing an axially-inwardly projecting sidewall on said dip tube structure, and engaging said pump with said sidewall.

9. A method for filling a container with a product to be dispensed comprising the steps of:

providing a container;

disposing a dip tube structure at least partially within the container, said dip tube structure comprising a dip tube, such that said dip tube extends substantially axially inwardly into the container, said dip tube being corrugated;

engaging a filling nozzle with the dip tube structure near an axially outward end of said dip tube;

dispensing a product through said filling nozzle so that it flows through said dip tube and into said container, whereby said product completely fills said dip tube and whereby said dip tube expands in diameter;

disengaging said filling nozzle from said dip tube structure; and attaching a pump to said dip tube structure after said step of disengaging said filling nozzle from said dip tube structure.

* * * * *